United States Patent [19]

Conner

[11] Patent Number: 4,841,651

[45] Date of Patent: Jun. 27, 1989

[54] GRAPHIC DYNAMIC GREETING CARD AND METHOD FOR MAKING SAME

[76] Inventor: Steven A. Conner, 11 Wenwood Dr., Glenhead, N.Y. 11545

[21] Appl. No.: 786,227

[22] Filed: Oct. 10, 1985

[51] Int. Cl.[4] ..... A47G 1/06

[52] U.S. Cl. ..... 40/160; 40/538

[58] Field of Search ..... 40/160, 214, 538, 124.1; 446/147, 148

[56] References Cited

U.S. PATENT DOCUMENTS

| | | | |
|---|---|---|---|
| 861,822 | 7/1907 | Feher | 40/160 |
| 2,748,256 | 5/1956 | Moran | 40/538 |
| 3,319,922 | 5/1967 | Christensen | 40/160 |
| 3,321,860 | 5/1967 | Dichtl et al. | 40/160 |
| 3,758,358 | 9/1973 | Kuroda | 40/160 |
| 3,775,867 | 12/1973 | Christenberry | 446/147 |

FOREIGN PATENT DOCUMENTS

| | | | |
|---|---|---|---|
| 1053916 | 1/1958 | Fed. Rep. of Germany | 40/538 |

*Primary Examiner*—Robert P. Swiatek
*Assistant Examiner*—Cary E. Stone
*Attorney, Agent, or Firm*—Robin, Blecker & Daley

[57] ABSTRACT

A greeting card comprises a relatively rigid substrate and a layer of resilient material having a first part secured to a surface of the substrate and a second part preformed to define a self-sustaining and elastically deformable three-dimensioned graphic figure. The layer second part is unsecured with respect to the substrate and is in movable relation thereto. The resilient layer first part defines continuous expanse in adhesively secured relation with the substrate surface and the layer second part is perimetrically continuous with the layer first part. The layer first part defines an interiorly open perimeter constituting the border outline of a face and the layer second part defines a face contiguous with the border outline. Also disclosed is method for making such greeting cards. Envelope structure is shown which permits breathing of the card and non-deformation of the graphic figure in transit.

6 Claims, 3 Drawing Sheets

GRAPHIC DYNAMIC GREETING CARD AND METHOD FOR MAKING SAME

FIELD OF THE INVENTION

This invention relates generally to greeting cards and pertains more particularly to greeting cards having deformable graphic display characteristics.

BACKGROUND OF THE INVENTION

The greeting card industry has, in recent years, evolved from somewhat staid and convervative status to look increasingly toward message conveyance through enhanced communication techniques, both in verbal and graphic practices. Thus, cards with higher personal communication level content have become widspread, particularly in verbal aspect.

In applicant's view, the graphics aspect of greeting cards has lagged behind the verbal aspect in enhancing message communication level. In particular, while greeting cards have long involved three-dimensional presentation, as by embossments and like fixed displays, presently known greeting cards lack graphic dynamic character inviting touch and animation.

SUMMARY OF THE INVENTION

The present invention has as its primary object the provision of improved greeting cards.

A more particular object of this invention is to provide greeting cards of graphic dynamic character and methods for the making thereof.

In effective attainment of these and other objects, the invention provides a greeting card comprising a relatively rigid substrate and a layer of resilient material having a first part secured to a surface of the substrate and a second part preformed to define a self-sustaining and elastically deformable three-dimensioned graphic figure. The layer second part is in movable relation to the substrate and a compressible medium, such as air intervenes the layer second part and the substrate and is entrapped therein.

In a particularly preferred embodiment, the resilient layer first part defines continuous expanse in adhesively secured relation with the substrate surface and the layer second part is perimetrically continuous with the layer first part. The layer first part defines an interiorly open perimeter consituting the border outline of a face and the layer second part defines a face contiguous with the border outline.

In its method for making a greeting card, the invention provides the outset step of providing a three-dimensional mold of a figure desired for a greeting card. In this step, the image of the figure may be sculpted in plasticene. Next, one applies a settable fluid, e.g., latex rubber, to the mold to thereby form a thin sheet of resilient material incorporating such figure and adapted to be locally deformed and otherwise in self-sustaining three-dimensioned configuration extending outwardly of the plane of the sheet. Then, one secures the sheet to a relatively rigid substrate in manner permitting the figure to be deformable in response to force applied thereto.

Greeting cards of the invention are amenable, indeed invitive, to touch which results in transient distortion of the graphic figure and prompt elastic restoration of same to original configuration. The substrate of cards of the invention may incorporate a fold section and are openable to display a verbal message where desired.

The invention further provides envelopes for such greeting cards thereof, wherein the greeting card relilient layer is maintained in communication with ambient air and the graphic figure is in self-sustaining and undistorted condition.

The foregoing and other objects and features of the invention will be further understood from the following detailed description of preferred embodiments thereof and from the drawings wherein like reference numerals identify like parts throughout.

DESCRIPTION OF PREFERRED EMBODIMENTS AND PRACTICES

Figure 2:
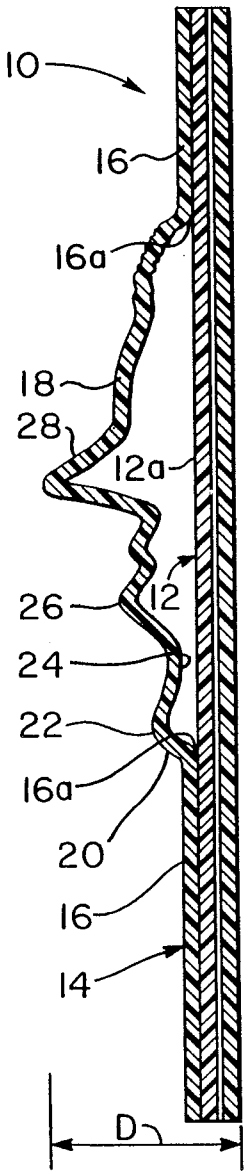
FIG. 2 is a sectional elevational of the FIG. 1 greeting card as would be seen from plane II—II of FIG. 1.
Figure 1:
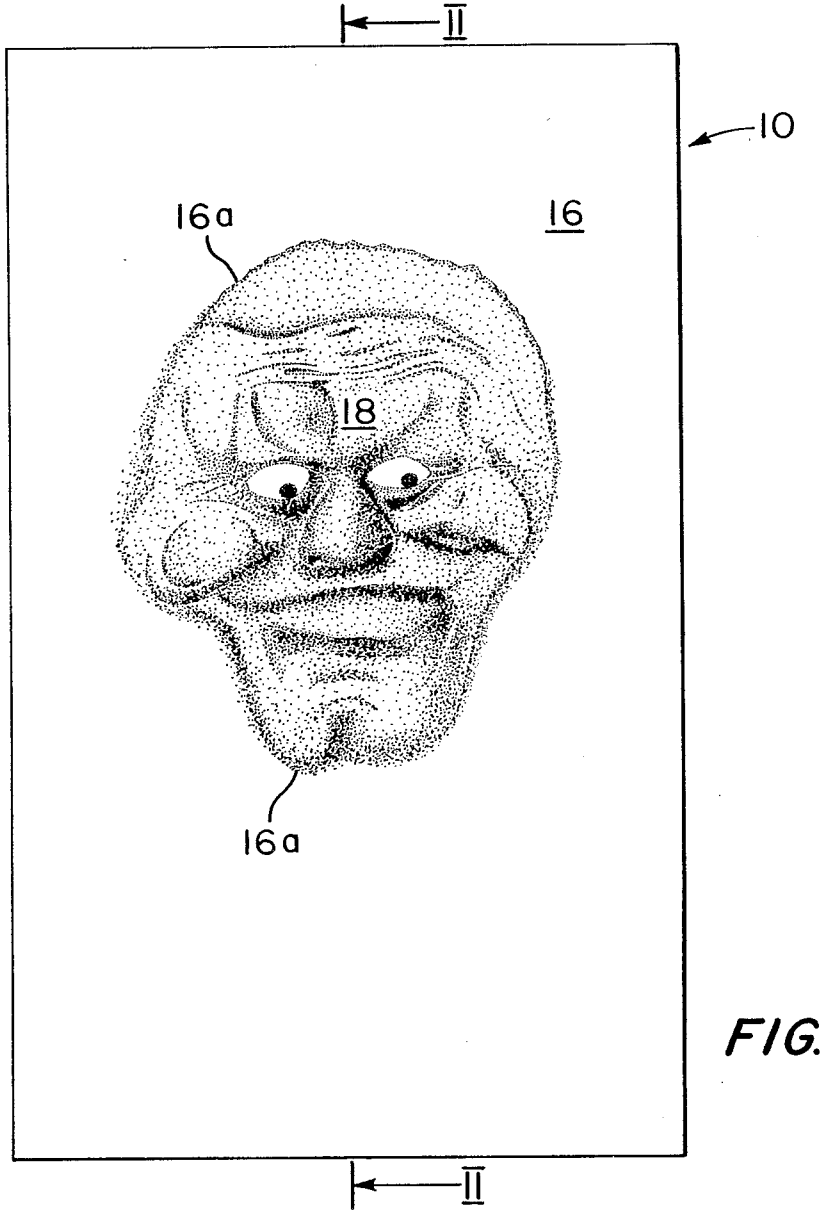
FIG. 1 is a front elevation of a typical embodiment of a greeting card in accordance with the invention.
Figure 4:
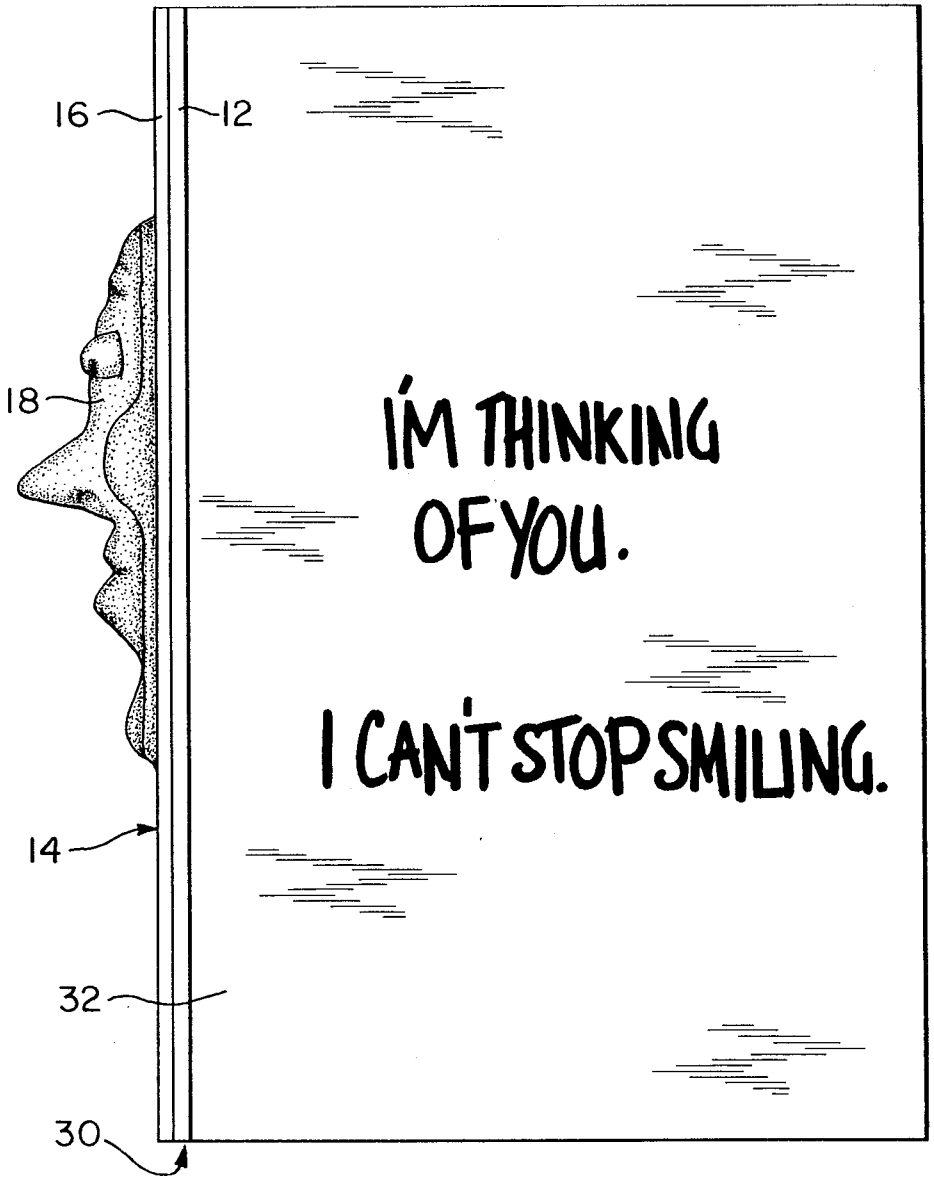
FIG. 4 is a front elevation of the greeting card of FIG. 1 with its front panel rotated ninety degrees from its FIG. 1 disposition to reveal the verbal message of the card.

Referring to FIGS. 1 and 2, greeting card 10 will be seen to include substrate 12 of relatively rigid material, such as cardboard or a suitable plastic, and a layer 14 disposed on substrate 12. Layer 14 is comrised of a resilient material, such as a sheet of thin latex, and has a first part 16 bordering a second part 18, the latter being shown in the configuration of a three-dimensioned graphic figure in the form of a smiling face of a ghoulish character. By practice discussed below, layer second part 18 is self-sustaining in its presentation of the graphic figure, the figure, however, being movable in relation to substrate 12 and also elastically deformable, i.e., will return to its original, self-sustaining configuration upon removal of deforming force applied thereto.

First part 16 of layer 14 is in secured relation to substrate 12, preferably defining continuous expanse adhesively secured to the substrate. With second part 18 of layer 14 being distal from the upper surface 12*a* of the substrate, it will be seen that layer first part 16 defines an interiorly open perimeter 16*a* constituting a border outline of layer second part 18 and hence of the figure therein. Layer second part 18 is shown as being perimetrically contiguous with such open perimeter 16*a*.

Layer second part 18, and hence its defined graphic figure, is fully movable relative to the substrate in the described structure, in which example, no adhesion exists as between layer second part 18 and the substrate. Thus, it will be seen that layer second part 18 includes a portion 20, forming the chin of the figure, which extends continuously from layer first part 16 to a first location 22 distal from the substrate to a second location 24, between chin portion 20 and lip portion 26 of the lips of the figure, the second location being less distal from the substrate but, nevertheless spaced therefrom to permit movement of the chin and lips of the figure.

Figure 3:
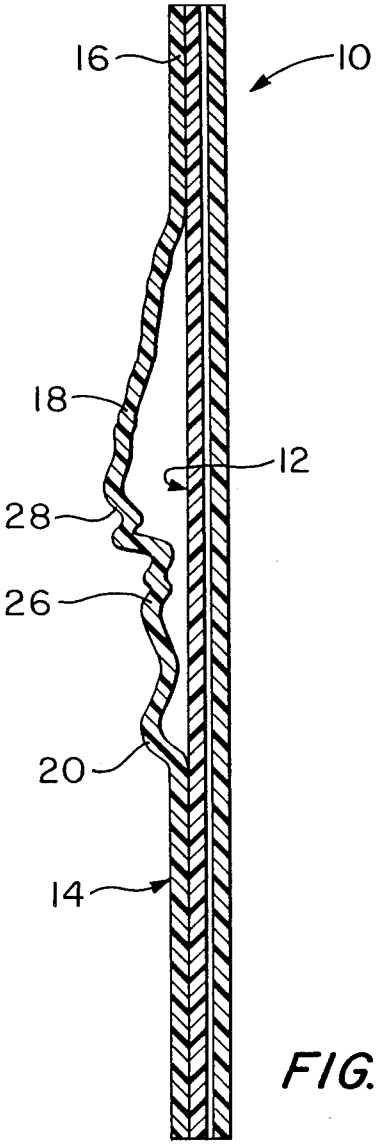
FIG. 3 is repeat showing from plane II—II of FIG. 1 with deforming force applied to the graphic figure of the FIG. 1 greeting card.

Upon application of deforming force to layer second part 18, as by the touch of a finger to the figure nose portion 28, the figure deforms, as illustrated in FIG. 3, distorting to provide a diverse visual impression of the character to the viewer.

Figure 5:
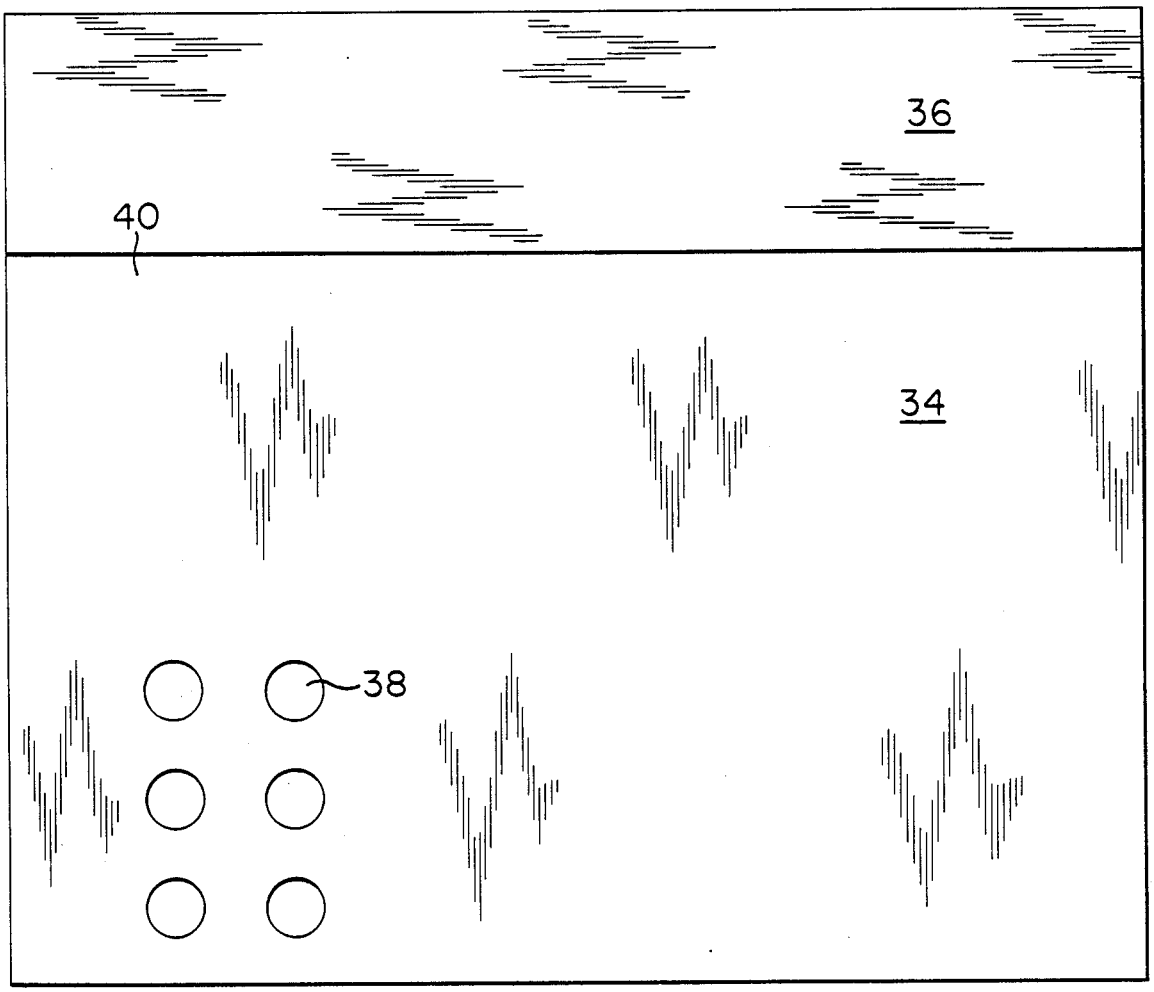
FIG. 5 is a front elevation of an envelope for the FIG. 1 greeting card with the envelope flap in open condition.

In FIG. 5, a greeting card in accordance with the invention is shown, with its front panel rotated ninety degrees, as including a substrate with a fold portion 30 from which oppositely directly extend the front panel substrate 12, supporting layer 14, and rear panel substrate part 32, the latter including a verbal message.

In its method for making a greeting card, the invention provides the outset step of providing a three-dimensional mold of a figure desired for a greeting card. In this step, the image of the figure may be sculpted in plasticene. Next, one applies a settable fluid, e.g., latex rubber, to the mold to thereby form a thin sheet of resilient material incorporating such figure and adapted to be locally deformed and otherwise in self-sustaining three-dimensioned configuration extending outwardly of the plane of the sheet. Where the sheet is not colored, or where it is colored, but plural coloration is desired in the figure, a step of painting the sheet is practiced. The card proper, i.e., the first discussed substrate alone or the folded substrate structure, now has applied thereto a layer of adhesive, such as any customary glue, and the latex sheet is disposed atop the adhesive to have its surface remaining in the plane of the sheet, i. e., layer first portion 16 above, selectively secured to the substrate, and the interior undersurface of the figure (layer second part 18) remote from the adhesive and hence free to move. A compressible medium, typically air, is entrapped within the assembly of latex sheet and substrate. Excess, if any, of the latex sheet extending beyond the border of the substrate is now trimmed as by cutting.

Figure 6:
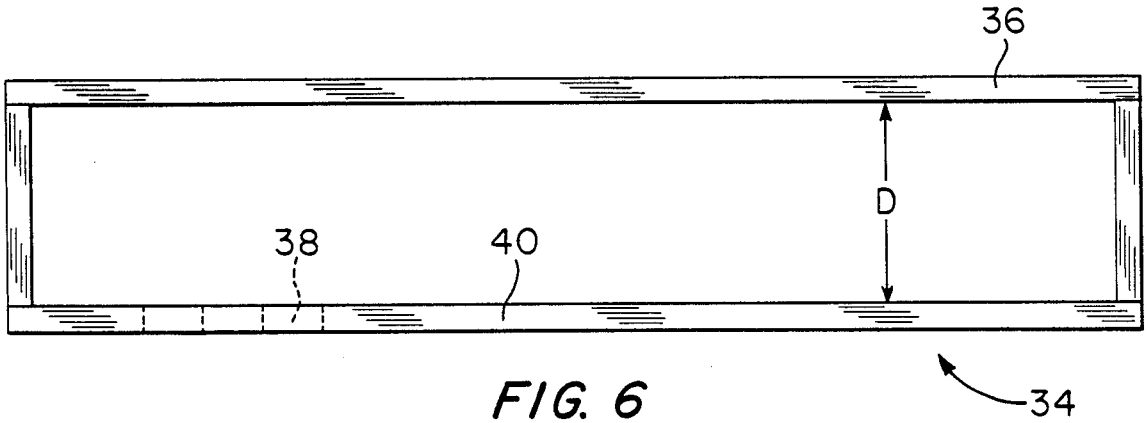
FIG. 6 is a top plan view of FIG. 5.

Turning now to FIGS. 5 and 6, greeting card envelope 34 has closure flap 36 and is formed of cardboard or other material adapted to define and maintain a pocket of depth D, corresponding to depth D (FIG. 2) of the greeting card with its graphic figure in projecting, self-sustaining and undeformed condition. Deformation of the graphic figure in the course of card transit is accordingly limited. Apertures 38 extend through the wall 40 of envelope 34 into the envelope interior, whereby the resilient latex sheet may be in communication with ambient environment and breathe during transit of the card.

Various changes maybe introduced to the foregoing articles and modifications may be made to the described method for manufacture without departing from the invention. Thus, the particularly described and depicted preferred embodiments and methods are intended in an illustrative and not in a limiting sense. The true spirit and scope of the invention are set forth in the appended claims.

I claim:

1. A greeting card, comprising:

(a) a relatively rigid substrate comprised of an air-impermeable material; and (b) a layer of an air-impermeable resilient material having a first part defining continuous expanse in secured relation to a surface of said substrate by an air-impermeable adhesive material disposed between said layer and said substrate and a second part performed to define a self-sustaining and elastically deformable three-dimensioned graphic figure, said layer second part being in unsecured relation to said substrate and movable relative thereto, said layer second part being perimetrically continuous with said layer first part, said substrate, said layer and said adhesive entrapping air between said layer second part and said substrate surface, in the course of deformation of said layer second part.

2. The invention claimed in claim 1 wherein said layer second part includes a portion extending continuously from said layer first part to a first location distal from said substrate surface and therefrom to a second location less distal from said substrate surface than said first location but spaced from said substrate surface.

3. The invention claimed in claim 1 wherein said layer first part defines an interiorly open perimeter constituting the border outline of a face and wherein said layer second part defines a face contiguous with said border outline.

4. The invention claimed in claim 1 wherein said substrate includes a fold portion, a first section extending in one direction from said fold portion and defining said substrate surface figure and a second section extending oppositely from said fold portion and bearing a verbal message.

5. The invention claimed in claim 4 wherein said layer first part defines an interiorly open perimeter constituting the border outline of a face and wherein said layer second part defines a face contiguous with said border outline.

6. The invention claimed in claim 5 wherein said face includes a portion extending continuously from said layer first part to a first location distal from said substrate surface and therefrom to a second location less distal from said substrate surface than said first location but spaced from said substrate surface.

* * * * *